US005894819A

United States Patent [19]

Motegi

[11] Patent Number: 5,894,819

[45] Date of Patent: Apr. 20, 1999

[54] WATER TUBE BOILER AND IT'S COMBUSTION METHOD

[75] Inventor: Toru Motegi, Tokyo, Japan

[73] Assignee: Tokyo Gas Company Limited, Tokyo, Japan

[21] Appl. No.: 08/751,569

[22] Filed: Nov. 18, 1996

[30] Foreign Application Priority Data

Nov. 20, 1995 [JP] Japan ..... 7-301659

[51] Int. Cl.[6] ..... F22B 23/06

[52] U.S. Cl. ..... 122/367.1; 122/18

[58] Field of Search ..... 122/367.1, 367.2, 122/367.3, 18

[56] References Cited

U.S. PATENT DOCUMENTS

| | | | |
|---|---|---|---|
| 3,638,621 | 2/1972 | Craig | 122/140.1 |
| 5,050,541 | 9/1991 | Kobayashi et al. | 122/367.1 |
| 5,259,342 | 11/1993 | Brady et al. | 122/367.1 |
| 5,273,001 | 12/1993 | Kayahara et al. | 122/18 |
| 5,353,748 | 10/1994 | Kayahara et al. | 122/367.3 |
| 5,482,009 | 1/1996 | Kobayashi et al. | 122/367.1 |

FOREIGN PATENT DOCUMENTS

| | | |
|---|---|---|
| 2 194 918 | 3/1974 | France . |
| 2-35884 | 8/1990 | Japan . |
| 07229608 | 8/1995 | Japan . |
| 07318021 | 12/1995 | Japan . |

*Primary Examiner*—Teresa J. Walberg
*Assistant Examiner*—Gregory Wilson
*Attorney, Agent, or Firm*—Pillsbury Madison & Sutro LLP

[57] ABSTRACT

A water tube boiler using jet flames is disclosed which is capable of achieving low CO-emission combustion without enlarging a size of a combustion chamber. The water tube boiler comprises a combustion chamber 1 in which jet flames are generated and rows 3*a* to 3*e* of water tubes inserted through the combustion chamber. The group of water tubes provides a portion thick with the water tubes and a portion empty of the water tubes in a cross-section perpendicular to the direction of the jet flames, and at least the space Sa as an empty portion continuously extends through said group of water tubes in the direction of the jet flames. In the space Sa as an "empty" portion provided between the rows 3*b* and 3*d* of water tubes, recirculating flows (shown by arrows) of a combustion gas are generated. The recirculating flows are entrained by the jet flames existing the portion "thick" with the water tubes. Consequently, rapid temperature decrease of the jet flames is prevented. This enables the jet flames to flow downstream while maintaining a CO oxidation promoting temperature of about 1,000 to 1,500° C., thereby promoting CO oxidation reaction. Accordingly, residual CO of an exhaust gas is greatly reduced.

13 Claims, 8 Drawing Sheets

WATER TUBE BOILER AND IT'S COMBUSTION METHOD

BACKGROUND OF THE INVENTION

1. Field of the Invention

The present invention, in particular, relates to a water tube boiler capable of reducing CO emission and a method for controlling combustion in the same.

2. Description of the Prior Art

A water tube boiler has been known which comprises a combustion chamber, a group of water tubes extending therethrough, and a burner for heating water passing through the group of water tubes by combustion gas to obtain hot water or steam. In such a water tube boiler, a large combustion zone is provided between the burner and the group of water tubes to sufficiently advance oxidation of CO into $CO_2$, and then heat exchange is effected between the combustion gas and the group of the water tubes disposed on further down stream from the combustion zone. This is because if heat exchange was carried out prior to sufficient oxidation of CO contained in the combustion gas, an exhaust gas would contain residual CO in an undesirable amount. Accordingly, the volume of the combustion chamber is unavoidably large.

To cope therewith, as a combustion method and an apparatus for carrying out the method which are capable of achieving low CO-generating combustion with a combustion chamber having a reduced size, there have been proposed those in which water tubes are placed in the vicinity of the tip of a flame to control the temperature of the flame within a range of about 1,000° C. to 1,500° C., and then the temperature-controlled combustion gas is caused to pass through an adiabatic space and then led into a heat exchanger to effect heat exchange, thereby realizing high intensity combustion while reducing CO emission (Japanese Examined Patent Publication No. 35884/1990). The method and the apparatus have been made in view of the fact that oxidation reaction of CO into $CO_2$ is promoted at a temperature within the range of about 1,000° C. to 1,500° C. The temperature of the flame is decreased in the first step by means of water tubes, and then CO is oxidized in the adiabatic space. It is thereby possible to realize a combustion chamber as a whole several times as small as a conventional combustion chamber and also realize low CO-generating combustion.

The method and the apparatus effectively function as means for achieving low NOx/low CO-generating combustion when used in a water tube boiler utilizing a burner capable of producing flat flames which are uniform almost throughout a section of a combustion chamber and develop two-dimensional flows (see, for example, Japanese Unexamined Patent Publication No. 229608/1995). However, it is required for realizing such low NOx/CO-generating combustion and for effectively utilizing the adiabatic space to generate flat flames spreading over the section of the combustion chamber. Further, a premixed combustion system is often used to reduce a size of a combustion chamber. However, the pre-mixer is required to generate a premixture, and a safety device peculiar to premixed combustion is required to prevent back fire, explosion or the like. These result in a very complicated structure of the combustion apparatus. Accordingly, it is desired to use a diffusion flame burner having a relatively simple structure in terms of reduction in a cost of the burner, and ease in manufacture and maintenance of a burner. It is also desired to attain low CO-generating combustion in a water tube boiler using a diffusion flame burner.

The present inventors have conducted various combustion experiments using diffusion flame burners to solve the above problems, and through the experiments, they have experienced that if use is made of, in a water tube boiler, a burner whose burner ports are located only at such positions as to provide jet flames each localized in a cross-section of a combustion chamber of the water tube boiler, the jet flames are rapidly cooled by water tubes to prevent CO oxidation reaction from satisfactorily proceeding, and accordingly, the size of the combustion chamber is unavoidably large so as to surely provide a sufficient combustion zone.

It is, therefore, an object of the present invention to provide a water tube boiler of such a type that it uses a diffusion flame burner with burner ports located only at particular positions in a burner mounting wall of a combustion chamber to generate jet flames, which has a novel structure capable of realizing a size-reduced combustion chamber and capable of continuously effecting stable low CO-generating combustion.

To solve the above problem, the present inventors have conducted combustion experiments using a water tube boiler as schematically shown in plan in FIG. 8. In FIG. 8, reference number 1 represents a combustion chamber having a rectangular section. A burner 2 is mounted in one end la of the combustion chamber 1, and a multiplicity of water tubes 3 are inserted through the combustion chamber 1 in the proximity of the burner 2.

FIG. 9 is an enlarged sectional view showing the burner 2 and a portion of the combustion chamber 1 in the vicinity thereof. FIG. 10 is a sectional view taken along the line X—X in FIG. 9. FIG. 11 is a fragmentary enlarged sectional view of the burner 2 taken along the line XI—XI in FIG. 10. As shown in FIG. 9, the burner 2 comprises a burner casing 21, an air pipe 22 having an inner diameter of D and disposed in the burner casing 21, a fuel pipe 10 inserted through the air pipe 22 coaxially therewith, a shielding plate 23 which contacts with the inside surface of the air pipe 22 and through which the fuel pipe 10 extends into the combustion chamber 1 having a section of 2D square, and a circular plate 24 attached to the front end of the fuel pipe 10.

As shown in FIG. 10, the shielding plate 23 are provided with four slot-like portions 25 at angular intervals of 90 degrees, each of which functions as an air injection portion. The fuel pipe 10 is provided with four fuel injection nozzles 26 adjacent to the shielding plate 23 which extend toward proximal edges of the slot-like portions 25. The tips 27 of the injection nozzles 26 are located in close vicinity of the proximal edges of the respective slot-like portions 25. The circular plate 24 has such a size that it is substantially inscribed in the proximal edges of the slot-like portions 25 when viewed in the axial direction of the fuel pipe 10. As shown in FIG. 10, the burner 2 constructed as described above is mounted on the combustion chamber 1 in such a manner that the slot-like portions 25 formed in the shielding plate 23 are arranged on the diagonal lines of the 2D square cross-section of the combustion chamber 1. Incidentally, the burner 2 is described in detail in Japanese Patent Application No. 106878 filed in the name of the applicant who is the same entity as the assignee (applicant) of the present application.

In the water tube boiler constructed as described above and used in the experiments, air from the air pipe 22 and a fuel gas from the fuel injection nozzle 26 are supplied from the four slot-like portions 25 adjacent to the one end 1*a* of the combustion chamber 1, and the fuel gas initiates combustion forming flame 4 not stabilized at the slot-like portions 25 generating through the group of water tubes 3 to effect heat exchange between the flame 4 and the water tubes 3.

The burner 2 was mounted on the water tube boiler at a distance L from the water tubes 3, i.e., at a standard position. The experiment was conducted using the burner 2 at a combustion rate of $28\times10^4$ kcal/h, and CO content of the resulting exhaust gas was measured. Then, with a combustion chamber which was altered so as to prolong the distance between the burner 2 and the water tubes 3 by about 60%, i.e., from L to 1.6 L, the same experiment was conducted. In this connection, the prolonged amount corresponds to about 20% of the visible flame length. The results are shown in FIG. 12.

As understood from FIG. 12, when combustion was carried out with the burner located at the standard position to expose the group of water tubes to the jet flames running therethrough, oxidation reaction of CO was retarded due to the jet flames being rapidly cooled by the water tubes. In consequence, CO emission was in excess of 200 ppm. On the other hand, when the distance between the burner and the water tubes was prolonged from L to 1.6 L to provide a longer combustion reaction zone on the upper side of the water tubes, CO emission was somewhat moderated but still not reduced sufficiently (to a level of 100 ppm or lower). To further reduce CO emission in this mode, a still larger combustion zone is required. This results in a undesirably large-sized boiler as a whole. Accordingly, it has experimentally been proved that the mode where a larger CO oxidation reaction zone is provided on the upper side of water tubes cannot suitably be employed with a view to obtaining a compact combustion chamber of a water tube boiler using jet flames.

Thereupon, the present inventor has further proceeded with experimental researches and consequently found that not by the mode where a prolonged CO oxidation reaction zone is provided on the upper side of water tubes but by providing a space empty of water tubes in the domain of a group of water tubes, which extends through the domain in the direction of jet flames, CO content of an exhaust gas is greatly reduced without enlarging a combustion chamber. The present invention has been made on the basis of the finding.

SUMMARY OF THE INVENTION

The present invention provides a water tube boiler comprising:

a combustion chamber in which jet flames are generated, and a group of water tubes inserted through the combustion chamber and extending across the direction of the jet flames, the group of water tubes providing a portion thick with the water tubes and a portion empty of the water tubes in a cross-section perpendicular to the direction of the jet flames, at least the empty portion continuously extending through the group of water tubes in the direction of the jet flames.

Further, the present invention provides a water tube boiler comprising:

a combustion chamber in which jet flames are generated, and a group of water tubes inserted through the combustion chamber and extending across the direction of the jet flames, the group of water tubes providing, in the combustion chamber, a space for recirculation of a combustion gas from down stream of the jet flames.

Moreover, the present invention provides a combustion method of a water tube boiler which has a combustion chamber and a group of water tubes extending therethrough and which generates jet flames at least through the group of water tubes to effect heat exchange, the method comprising:

recirculating a combustion gas having a high temperature in the combustion chamber by means of the currents of the jet flames, and entraining the recirculated combustion gas into the jet flames to thereby depress temperature decrease of the jet flames by the water tubes.

According to the water tube boiler and the combustion method of the water tube boiler of the present invention, CO concentration of an exhaust gas is reliably reduced. This is believed to be attributable to the following mechanism. In the water tube boiler according to the present invention, the group of water tubes are not uniformly distributed in a cross-section of the combustion chamber which is perpendicular to the direction of the jet flames but so arranged as to provide a portion thick with the water tubes and a portion empty of the water tubes, and at least empty portion continuously extends through the group of water tubes in the direction of the jet flames, i.e., it continuously extends through the group of water tubes in the direction of the jet flames.

By virtue of this, when jet flames existing through the portion thick with water tubes are generated, the jet flames entrain a combustion gas having a high temperature which is present in the space as an empty portion continuously extending through the group of water tubes in the direction of the jet flames, thereby flowing downstream while entraining the combustion gas having a high temperature. As a result, rapid temperature decrease of the jet flames in the course of passage of the jet flames through the portion thick with the water tubes is prevented. The jet flames are thereby maintained in a CO oxidation promoting temperature range of about 1,000 to 1,500° C. Accordingly, oxidation reaction of CO into $CO_2$ satisfactorily proceeds. In other words, recirculation of the combustion gas is enhanced, and thus rapid temperature decrease of the jet flames passing through the group of water tubes is prevented to promote oxidation reaction of CO.

The space as an empty portion may be provided at any position in a cross-section of the combustion chamber. To surely generate recirculating flows of a combustion gas having a high temperature, however, it is preferred that the space be provided at a position where at least a center of a jet flame does not pass through. Further, a space or a plurality of spaces may be provided in a cross-section of the combustion chamber. The space may be located at the center or at the positions adjacent to the opposite side walls in a cross-section of the combustion chamber.

DESCRIPTION OF THE PREFERRED EMBODIMENTS

In the following, preferred embodiments of the present invention will be described.

Figure 1:
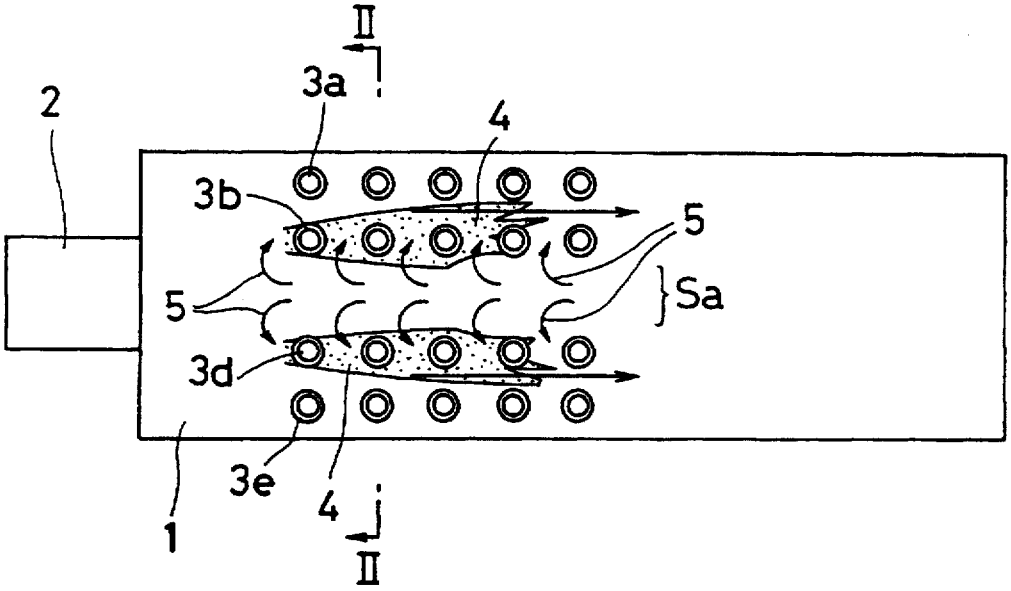
FIG. 1 is an illustrative view showing one embodiment of the water tube boiler according to the present invention in plan.
Figure 2:
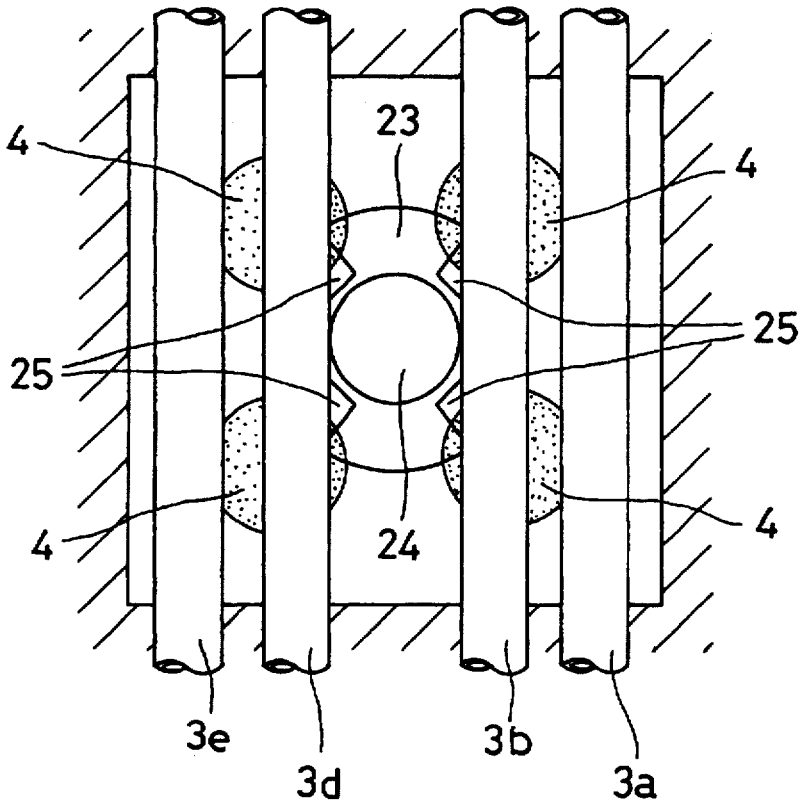
FIG. 2 is an enlarged sectional view taken along the line II—II in FIG. 1.

FIG. 1 is an illustrative view showing one embodiment of the water tube boiler according to the present invention in plan. FIG. 2 is an enlarged sectional view taken along the line II—II in FIG. 1 and viewed upstream from the down stream of jet flames. In this connection, the water tube boiler and the burner used therein which are illustrated in these FIGS. are substantially the same as those described in the foregoing with reference to FIGS. 8 to 11 except that water tubes are arranged in a different manner, and therefore, like reference numbers are allotted to like parts to eliminate overlapping explanation.

Figure 8:
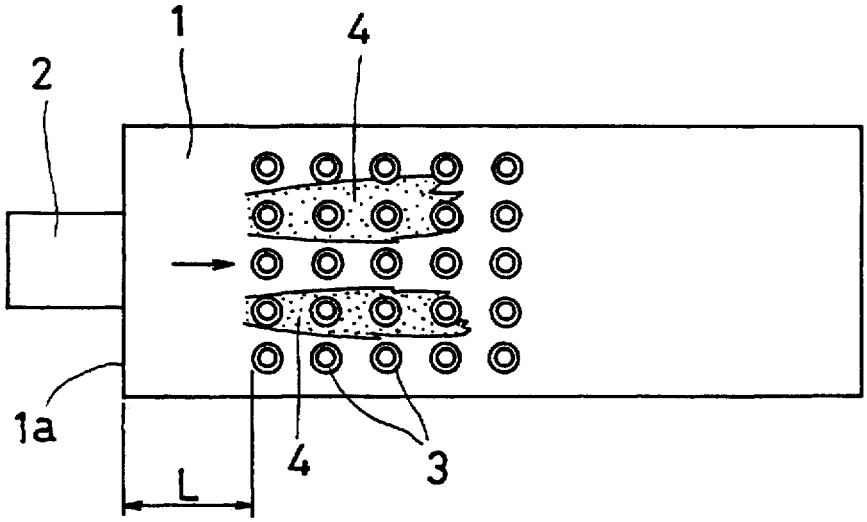
FIG. 8 is an illustrative view showing a conventional water tube boiler in plan which was used in the experiments.
Figure 9:
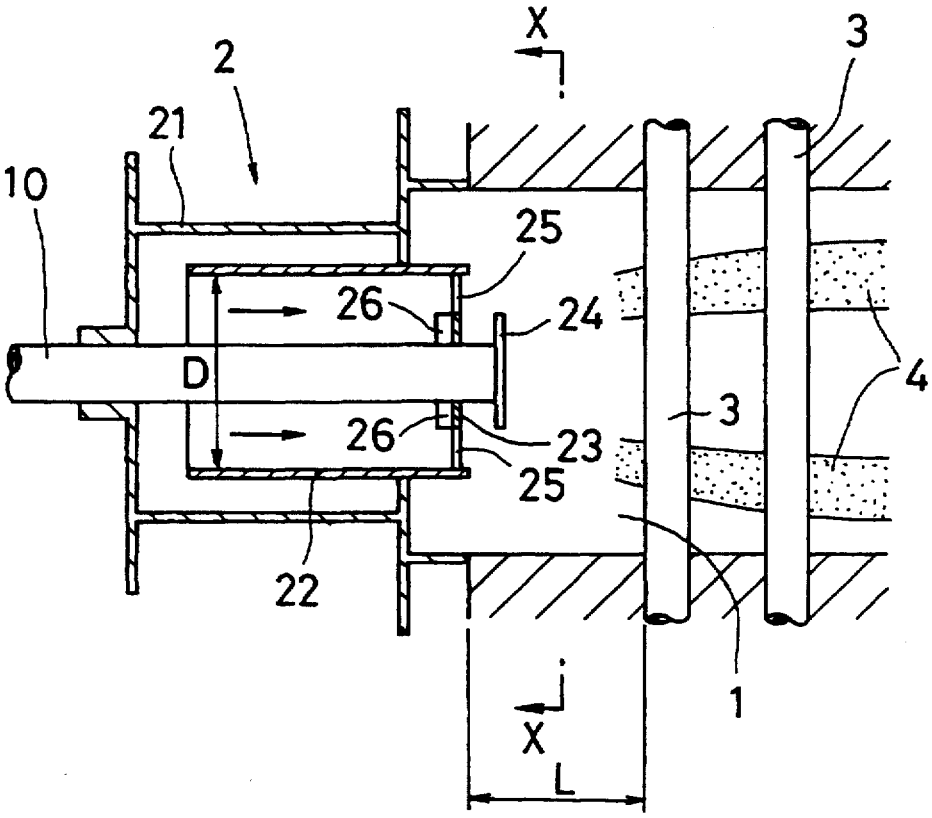
FIG. 9 is an enlarged sectional view showing the burner and a portion in the vicinity thereof.
Figure 10:
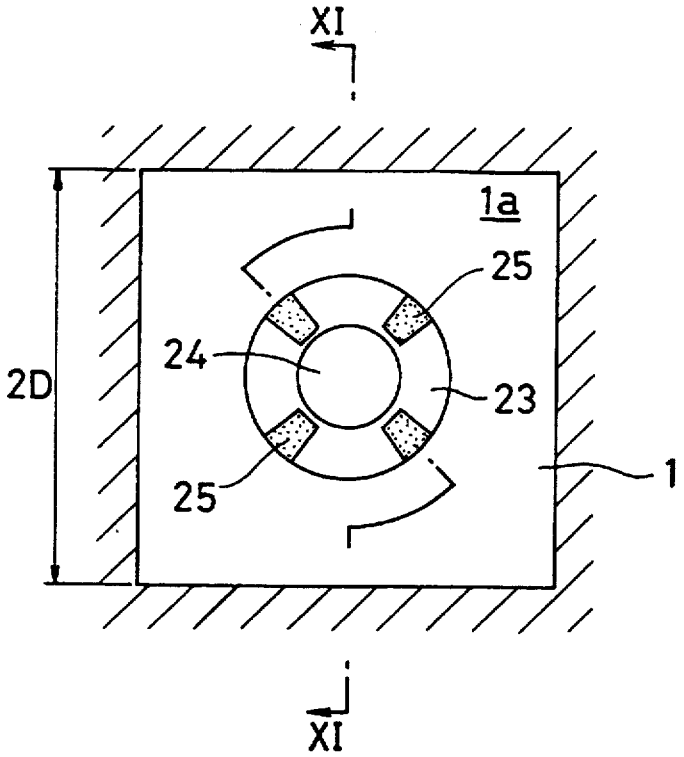
FIG. 10 is a sectional view taken along the line X—X in FIG. 9.
Figure 11:
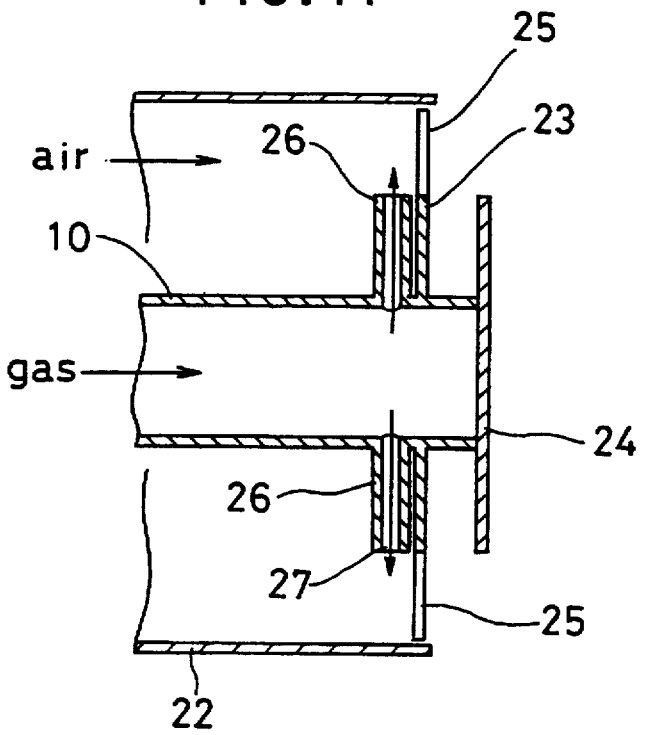
FIG. 11 is a fragmentary enlarged sectional view illustrating the burner used in the experiments, which is taken along the line XI—XI in FIG. 10.

In this water tube burner, the distance between the water tubes 3 and the burner 2 is the same as that shown in FIG. 8 (the burner is located at the standard position), and the distances between the water tubes are also the same as those in FIG. 8. It is, however, to be noted that the water tubes are arranged in such a manner that of the water tubes in five rows in the water tube boiler shown in FIG. 8, the center row of water tubes is omitted in whole. In other words, in a cross-section perpendicular to the direction of the jet flames 4, distances between one side wall of the combustion chamber 1 and a row 3*a* of water tubes, between the row 3*a* and a row 3*b* of water tubes, between a row 3*d* of water tubes and a row 3*e* of water tubes, and between the row 3*e* and the other side wall of the combustion chamber 1 are small to provide "thick" portions, and a distance between the row 3*b* and the row 3*d* is large to provide a center "empty" portion. The thus provided "empty" portion as a space Sa continuously extends through the domain of a group of water tubes in the direction of the jet flames.

Figure 3:
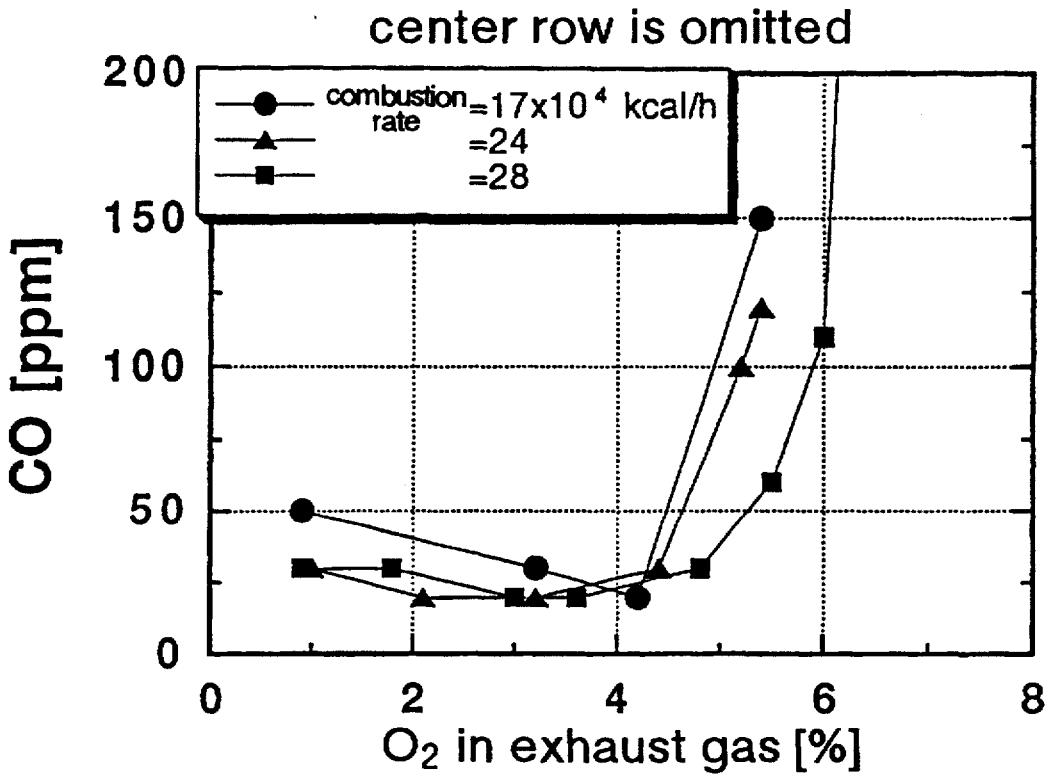
FIG. 3 is a graph showing CO-emission reductive results by means of the water tube boiler shown in FIG. 1.

Using the water tube boiler, combustion experiments were conducted with three different combustion rates. The results are shown in FIG. 3. As is apparent from FIG. 3, the residual CO content of the exhaust gas in each case is in the main lower than 100 ppm. Thus, low CO-emission combustion is achieved without changing the size of the combustion chamber.

This is believed to be attributable to the following phenomenon. In the space Sa as an "empty" portion provided between the rows 3*b* and 3*d* of water tubes, recirculating flows 5 (shown by arrows) of combustion gas at a high temperature are generated as shown in FIG. 1. These recirculating flows are entrained by the jet flames 4 running through the portions "thick" with the water tubes. This prevents rapid drop of the temperature of the jet flames, and hence, enables the jet flames 4 to downstream flow while maintaining a CO oxidation promoting temperature of about 1,000° C. to about 1,500° C.

Figure 4:
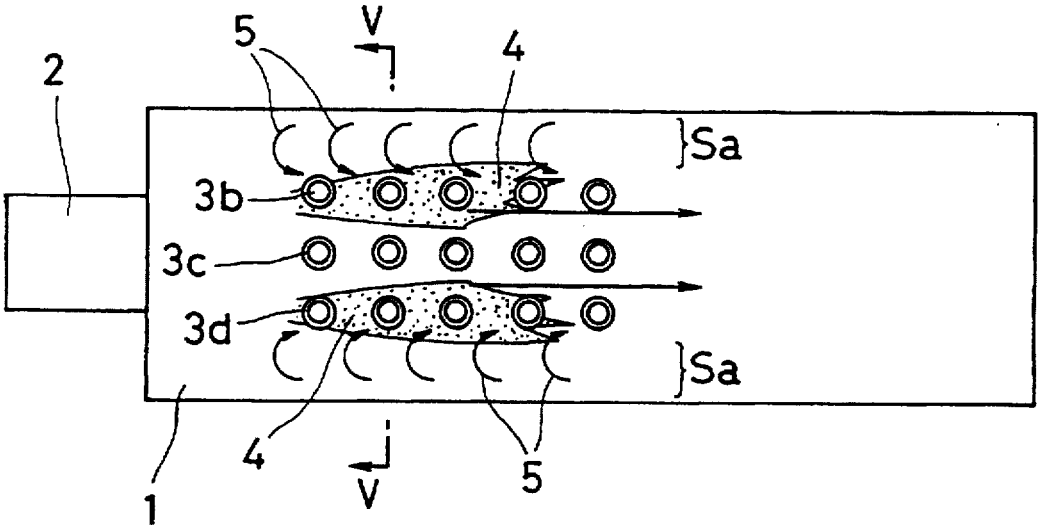
FIG. 4 is an illustrative view showing another embodiment of the water tube boiler according to the present invention in plan.
Figure 5:
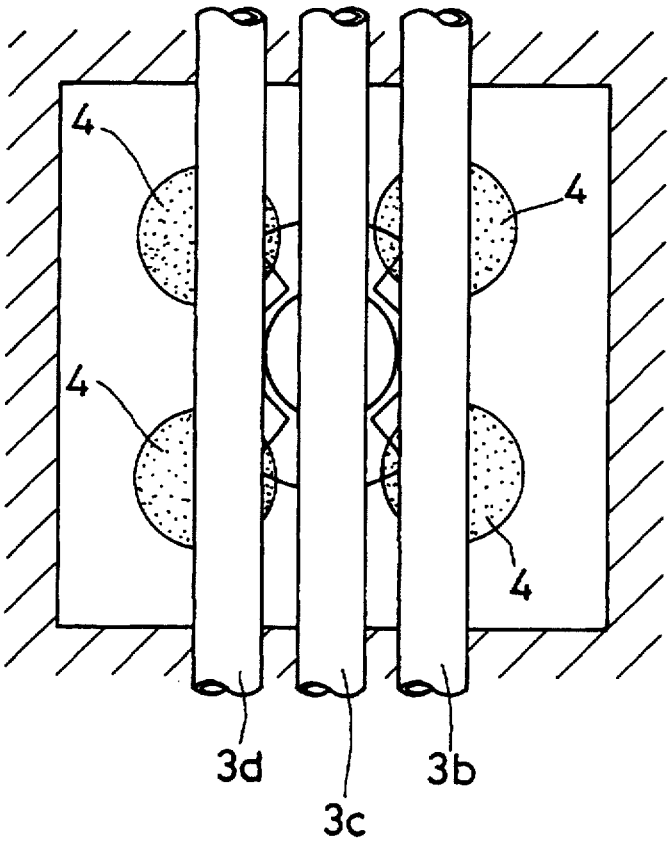
FIG. 5 is an enlarged sectional view taken along the line V—V in FIG. 4.

FIGS. 4 and 5 show another embodiment of the water tube boiler according to the present invention. In this embodiment, the two water tube rows 3*a* and 3*e* which are proximate to the side walls of the combustion chamber 1 are omitted. In consequence, distances between one side wall of the combustion chamber and the row 3*b*, and between the row 3*d* and the other wall of the combustion chamber are large to provide "empty" portions, and the distances between the row 3*b* and the row 3*c*, and between the row 3*c* and the row 3*d* are small to provide a "thick" portion. Accordingly, in this embodiment, the two vacancies along the side walls of the combustion chamber provide the "empty" portions which function as spaces Sa. In the spaces Sa, recirculating flows 5 (shown by arrows) of combustion gas at a high temperature are generated as shown in FIG. 4. The recirculating flows are entrained by the jet flames 4 running through the "thick" portion.

Figure 6:
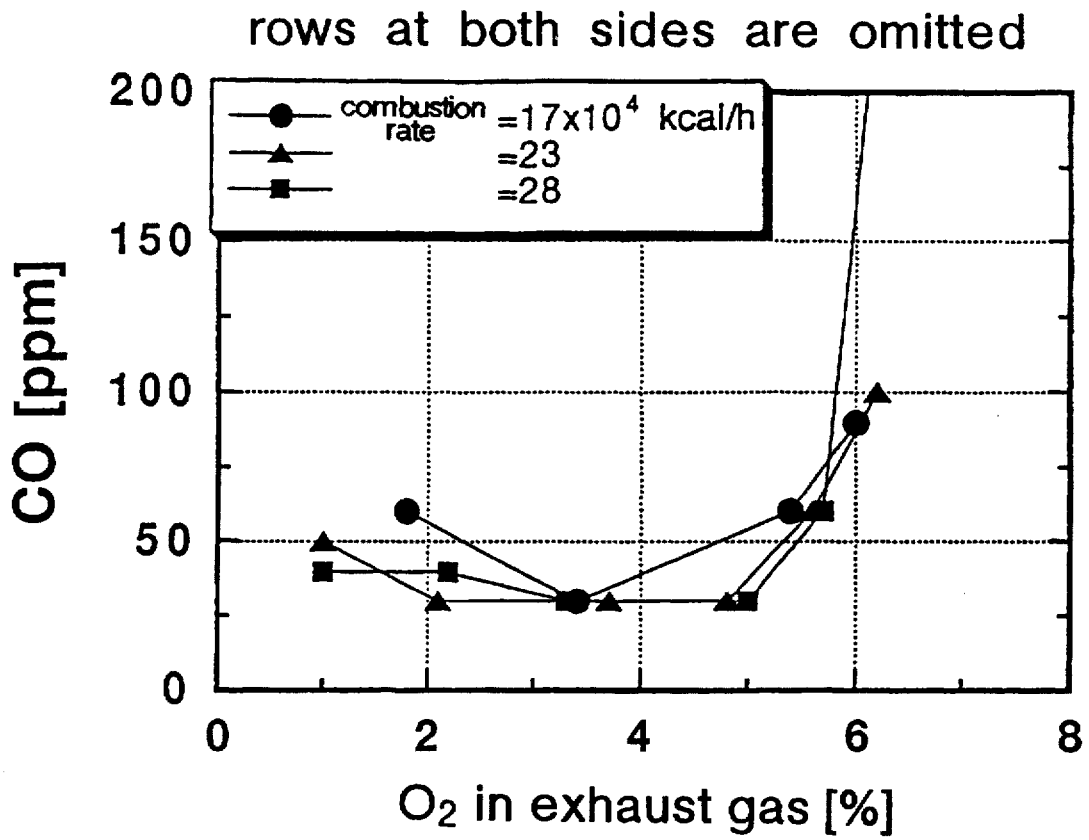
FIG. 6 is a graph showing CO-emission reductive results by means of the water tube boiler shown in FIG. 4.

FIG. 6 shows results of combustion experiments which were carried out with three different combustion rates. As is apparent from FIG. 6, also with this embodiment, the residual CO concentration of the exhaust gas in each case is in the main lower than 100 ppm. The desired end is thereby achieved.

Figure 7:
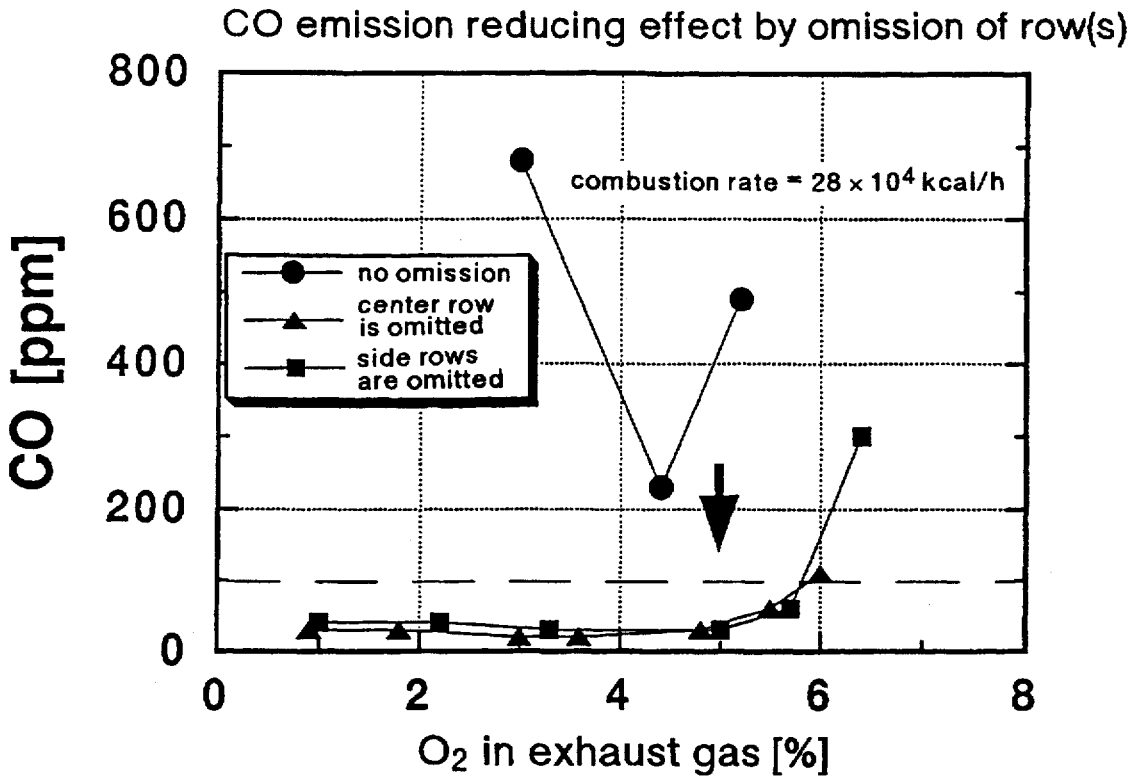
FIG. 7 is a comparative graph showing the CO-emission reductive effects.
Figure 12:
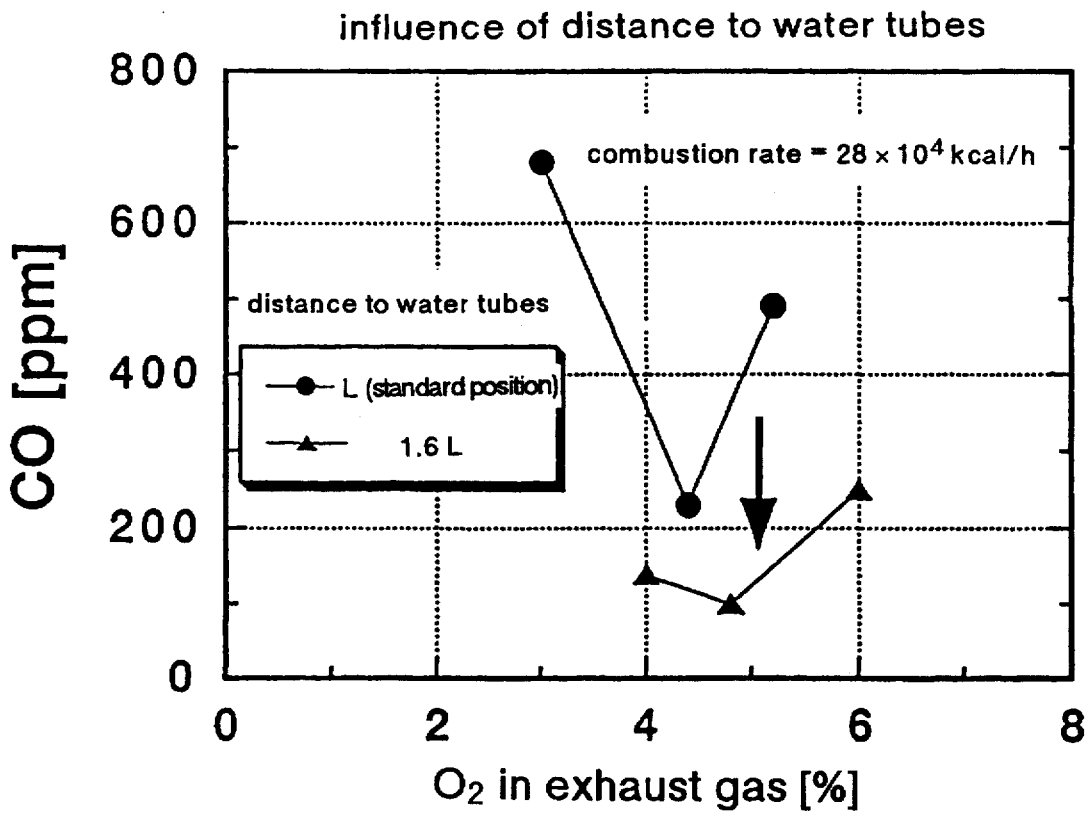
FIG. 12 is a graph showing CO emission by the water tube boilers of the type as shown in FIG. 8.

FIG. 7 is a graph showing the CO emission (ppm) at a combustion rate of $28\times10^4$ kcal/h which are extracted from the results in FIGS. 3, 6 and 12. As is apparent therefrom, the CO emission are greatly different between the cases where a row or rows of water tubes are omitted (water tube boiler provided with a space or spaces Sa capable of generating recirculating flows of combustion gas at a high temperature) and the case where no water tube is omitted (conventional water tube boiler), although the same combustion chamber and the same burner are used. In each of the cases where a row or rows of water tubes are omitted, the CO emission is in the main lower than 100 ppm. Thus, the effectiveness of the present invention is demonstrated.

In the above embodiments, the burner used is a new jet-flame burner according to the above-mentioned Japanese Patent Application which has previously been filed by the applicant who is the same entity as the applicant (assignee) of the present application. It is, however, to be noted that the burner is not restricted thereto, and that any burner may be used to attain substantially the same CO emission reducing effect so long as it is capable of producing a jet flame. There is no particular restriction with respect to the number and the position of the space Sa as an "empty" portion so formed as to extend in the direction of the jet flames. Of course, the number and the position of the space Sa are not restricted to the space at the center position or the spaces at the positions adjacent to the opposite side walls of the combustion chamber. Depending upon the size of the combustion chamber, an appropriate number of spaces Sa may be provided at appropriate positions.

According to the present invention, in a water tube boiler using a jet flame, it is possible to attain low CO-emission combustion without enlarging a combustion chamber.

What is claimed is:

1. A water tube boiler for reducing CO emission comprising;

a combustion chamber in which jet flames are generated from a burner at one end of said combustion chamber, and a group of water tubes downstream from said burner inserted through the combustion chamber and extending across the direction of the jet flames, said group of water tubes providing a portion thick with the water tubes and a portion empty of the water tubes in a cross-section perpendicular to the direction of the jet flames, at least said empty portion continuously extending through said group of water tubes In the direction of the jet flames, wherein the arrangement of said group of water tubes prevents a rapid temperature decrease of She jet flames and thereby, maintains a promotion of CO oxidation.

2. A water tube boiler for reducing CO emission comprising:

a combustion chamber In which jet flames are generated from a burner at one end of said combustion chamber, and a group of water tubes downstream from said burner inserted through the combustion chamber and extending across the direction of the jet flames, said group of water tubes providing a portion thick with water tubes and a portion empty with water tubes, said portion empty with water tubes continuously extending through said group of tubes in the direction of said Jet flames, said group of water tubes providing, in said combustion chamber, a space for recirculation of a combustion gas from down stream of the jet flames to Prevent a rapid temperature decrease of the jet flames and thereby maintain a Promotion of CO oxidation reaction.

3. A combustion method of a water tube boiler which has a combustion chamber with a burner at one end of said combustion chamber and a group of water tubes downstream from said burner extending in a direction across the combustion chamber, said group of water tubes providing a portion thick with water tubes and a portion empty with water tubes, said portion empty with water tubes continuously extending through said group of water tubes in a direction of the jet flames, said combustion chamber generating jet flames running at least through the group of water tubes to effect heat exchange, said method comprising:

recirculating a combustion gas having a high temperature in the combustion chamber by means of the currents of the jet flames;

entraining the recirculated combustion gas into the jet flames to thereby depress temperature decrease of the let flames by the water tubes; and thereby reducing CO in said gas.

4. The combustion method of claim 3, wherein said direction across the combustion chamber is in a direction perpendicular to the jet flames.

5. The combustion method of claim 3, wherein the empty portion is located in the core of the chamber.

6. The combustion method of claim 3, wherein the empty portion is located adjacent to opposite side walls in the combustion chamber.

7. The water tube boiler of claim 1, wherein the empty portion is located in the core of the chamber.

8. The water tube boiler of claim 1, wherein the empty portion is located adjacent to opposite side walls in the combustion chamber.

9. The water tube boiler of claim 2, wherein the empty portion is located in the core of the chamber.

10. The water tube boiler of claim 2, wherein the empty portion is located adjacent to opposite side walls in the combustion chamber.

11. A water tube boiler for reducing CO emission comprising:

a combustion chamber in which jet flames are generated from a burner at one end of said combustion chamber, and a concentrated grouping of water tubes downstream from said burner extending through the combustion chamber across the direction of the jet flames, said concentrated grouping of water tubes defining one or more open pathways continuously extending lengthwise through said concentrated grouping of water tubes in the direction of the jet flames, wherein said one or more pathways has a width that Is greater than the distance between adjacent tubes in said concentrated grouping of tubes, wherein the arrangement of said group of water tubes prevents a rapid temperature decrease of the jet flames and thereby maintains a promotion of CO oxidation.

12. The water tube boiler of claim 11, wherein said pathway is located adjacent to opposite side walls in said combustion chamber.

13. The water tube boiler of claim 11, wherein said pathway is located at the core of said chamber.

* * * * *